US007870967B2

(12) United States Patent
Sawyer

(10) Patent No.: US 7,870,967 B2
(45) Date of Patent: Jan. 18, 2011

(54) CHILD-RESISTANT VIAL CLOSURE

(75) Inventor: Duane Sawyer, York, PA (US)

(73) Assignee: Berry Plastics Corporation, Evansville, IN (US)

( * ) Notice: Subject to any disclaimer, the term of this patent is extended or adjusted under 35 U.S.C. 154(b) by 472 days.

(21) Appl. No.: 11/940,901

(22) Filed: Nov. 15, 2007

(65) Prior Publication Data

US 2008/0116163 A1 May 22, 2008

Related U.S. Application Data

(60) Provisional application No. 60/866,187, filed on Nov. 16, 2006.

(51) Int. Cl.
*B65D 55/02* (2006.01)

(52) U.S. Cl. ..... 215/225

(58) Field of Classification Search ..... 215/DIG. 3, 215/316, 200, 225, 224, 216, 201, 292, 280, 215/273, 237, 346, 343, 341; 220/790, 791, 220/789, 834, 833, 836, 810, FOR. 207, FOR. 203, 220/FOR. 195, FOR. 192, FOR. 101, 200, 220/283, 282, 281, 260, 254.3, 254.1; 222/544, 222/153.03, 153.01; D9/434, 449, 440, 439
See application file for complete search history.

(56) References Cited

U.S. PATENT DOCUMENTS 211,529 A * 1/1879 Silvester ..... 215/235
1,042,237 A * 10/1912 Koufman ..... 215/237
3,268,106 A * 8/1966 Satz ..... 220/789
3,612,322 A * 10/1971 Linkletter ..... 215/225
3,845,872 A * 11/1974 Towns et al. ..... 215/224
4,047,495 A * 9/1977 O'Brian ..... 215/224
4,433,790 A * 2/1984 Gibson ..... 215/246
4,747,511 A * 5/1988 Dutt et al. ..... 220/254.2
5,690,246 A * 11/1997 Anderson et al. ..... 220/254.7
6,523,709 B2 2/2003 Miceli et al.
6,926,161 B2 8/2005 Miceli et al.
2002/0148802 A1* 10/2002 Takahashi et al. ..... 215/237
2003/0201283 A1* 10/2003 Branson et al. ..... 222/153.14
2006/0273060 A1 12/2006 Fricke
2007/0144996 A1* 6/2007 Sawyer ..... 215/235
2007/0181522 A1* 8/2007 Davidson ..... 215/228

FOREIGN PATENT DOCUMENTS

DE 3238076 A1 * 9/1983
GB 2245549 A * 1/1992

* cited by examiner

*Primary Examiner*—Anthony Stashick
*Assistant Examiner*—Robert J Hicks
(74) *Attorney, Agent, or Firm*—Barnes & Thornburg LLP

(57) ABSTRACT

A vial includes a container having a receptacle formed to include an interior region and a mouth opening into the interior region and a child-resistant closure for the container. The closure includes a cap to be mounted on the receptacle in a closed position to close the mouth and separated from the receptacle to open the mouth. A latch coupled to the closure mates with a lug coupled to the container to retain the closure in a closed position on the container.

16 Claims, 4 Drawing Sheets

CHILD-RESISTANT VIAL CLOSURE

This application claims priority under 35 U.S.C. §119(e) to U.S. Provisional Application Ser. No. 60/866,187, filed Nov. 16, 2006, which is expressly incorporated by reference herein.

BACKGROUND

The present disclosure relates to vials, and in particular, closures for vials. More particularly, the present disclosure relates to a child-resistant flip-top cap included in a vial closure.

SUMMARY

In accordance with the present disclosure, a vial includes a child-resistant closure mounted on a container. The child-resistant closure includes a cap retainer that mates with retention lugs included in the container. The child-resistant container can be opened by an adult aware of the technique for unmating the cap retainer from the retention lugs.

In illustrative embodiments, the cap retainer includes an inner cap-retention latch that mates with an inner retention lug located on an interior portion of a receptacle included in the container. The cap retainer also includes an outer cap-retention latch that mates with a ring-shaped outer retention lug on an exterior portion of the receptacle included in the container.

To "open" the child-resistant closure in an illustrative embodiment, a user pushes downwardly on a button to unmate the inner cap-retention latch from the ring-shaped outer retention lug. The user also lifts upwardly on a lift-tab included in the child-resistant closure to unmate the outer cap-retention latch from the ring-shaped outer retention lug. The user can then move the child-resistant closure relative to the container to an "opened" position separated from the receptacle.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 6 is a perspective view similar to FIG. 5 of a portion of the vial showing movement of an inner latch actuator included in the flip-top cap in response to a downward force applied, for example, by a thumb of a user, to move the short-arc inner cap-retainer latch relative to the container to disengage the radially inwardly extending inner retention lug included in the container during a "first" stage of opening the flip-top cap;

FIG. 7 is a view similar to FIG. 6 showing movement of an outer latch actuator included in the child-resistant closure in response to an upward force applied, for example, by an index finger of the user (while the user's thumb continues to push downwardly on a button included in the inner latch actuator), to move the long-arc outer cap-retainer latch relative to the container to disengage the radially outwardly extending ring-shaped outer retention lug included in the container during a "second" stage of opening the flip-top cap; and FIG. 8 is a view similar to FIG. 7 showing movement of the flip-top cap (on the hinge) away from the closed position toward the opened position during a "third" stage of opening the flip-top cap.

DETAILED DESCRIPTION

Figure 1:
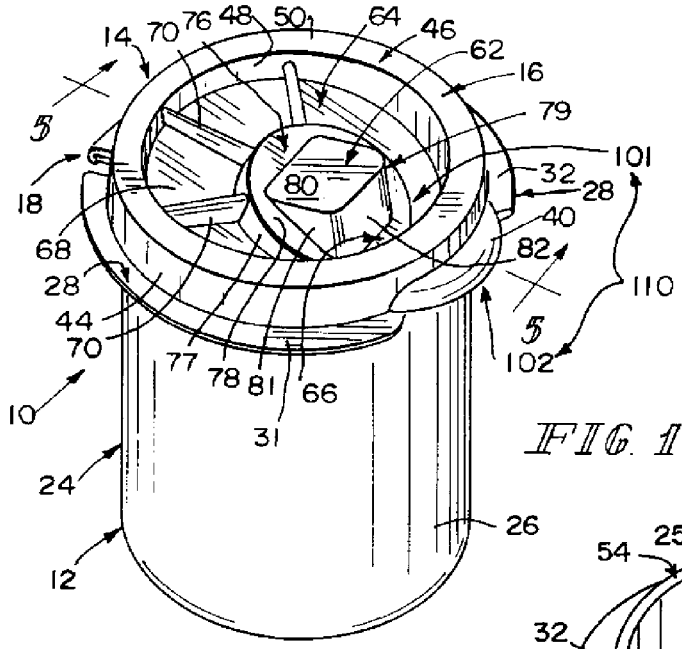
FIG. 1 is a perspective view of a vial including a child-resistant closure mounted on a container to cover a mouth opening into an interior region formed in the container and formed to include a flip-top cap retained in a "closed" position on the underlying container.
Figure 2:
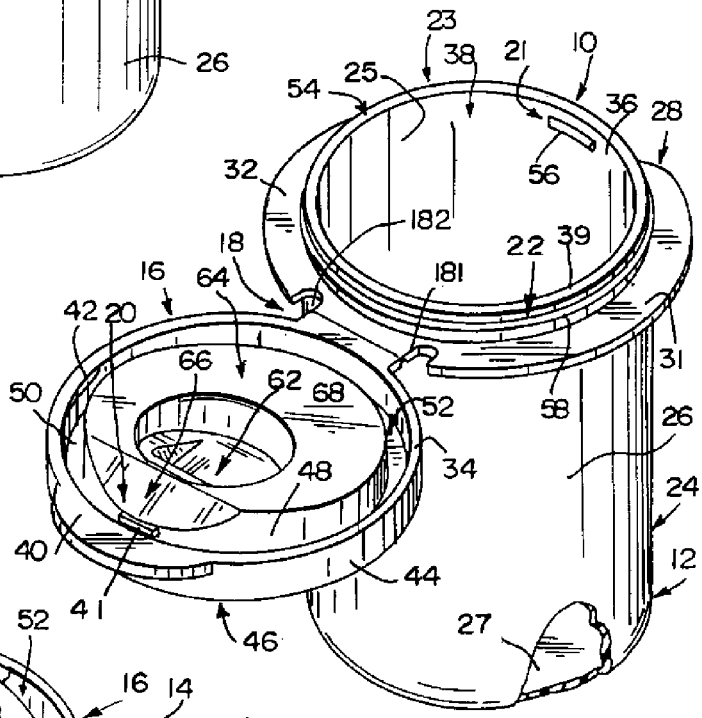
FIG. 2 is another perspective view of the vial of FIG. 1 after movement of the flip-top cap on a hinge included in the child-resistant closure relative to the container to an "opened" position and showing that the container includes a cap-shield collar coupled to a cylindrical outer wall of the container and arranged to extend about 320° around the cylindrical outer wall from one side of the hinge to another side of the hinge, an inner retention lug appended to a "right-side" portion of a cylindrical inner wall of the container and located near the mouth of the container, and a ring-shaped outer retention lug appended to the cylindrical outer wall of the container and located below a circular top edge of the container and above the cap-shield collar.

A via 10 includes a container 12 and a child-resistant closure 14 including a flip-top cap 16 and a hinge 18 coupled to container 12 and flip-top cap 16 as shown, for example, in FIGS. 1 and 2. Closure 14 also includes a cap retainer 20 appended to flip-top cap 16 as shown, for example, in FIGS. 2 and 4 and configured to mate with lugs 21, 22 included in container 12 as suggested, for example, in FIG. 5 to retain flip-top cap 16 in a "closed" position on container 12 so that flip-top cap 16 cannot be opened easily by children. An adult aware of the technique for unmating cap retainer 20 from lugs 21, 22 to open flip-top cap 16 can do so as suggested, for example, in FIGS. 6-8.

Vial 10 is monolithic in the illustrated embodiment and thus is formed as a single piece of plastics material, in three sections, container 12, hinge 18, and flip-top cap 16. Vial 10 is formed using any suitable molding technique.

Figure 3:
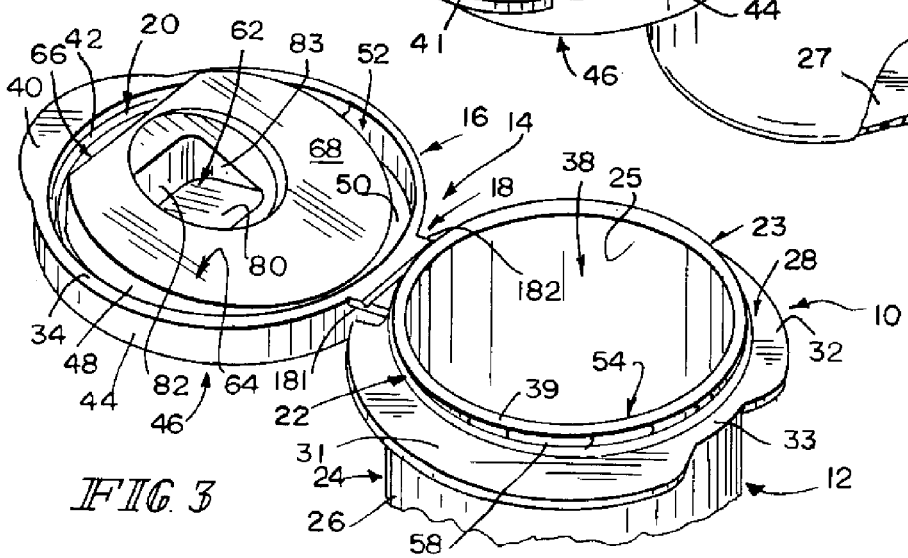
FIG. 3 is a second perspective view of the vial of FIG. 1 showing the flip-top cap in the opened position and taken from a different point of view.
Figure 5:
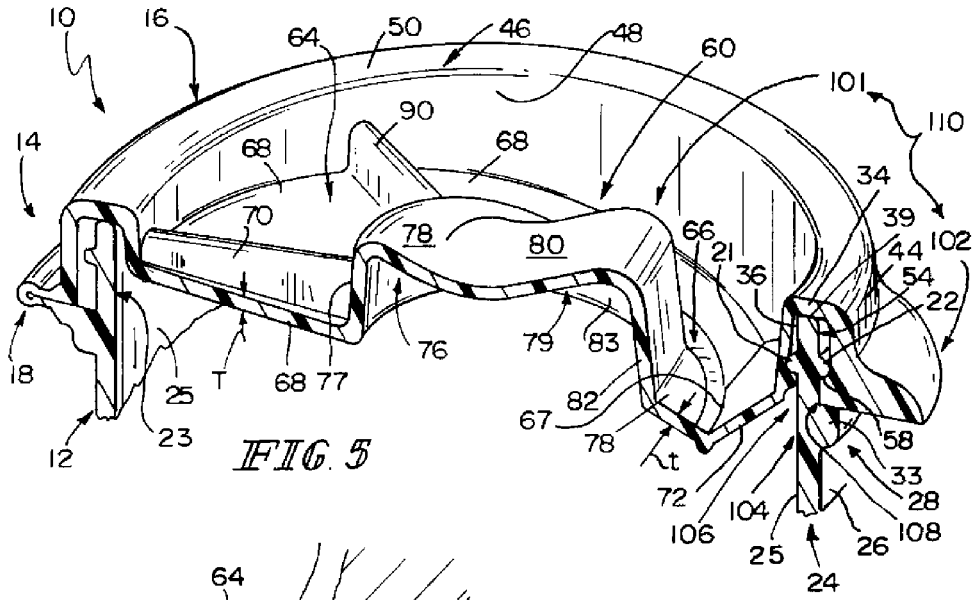
FIG. 5 is an enlarged perspective view of the vial of FIG. 1, broken away along section line 5-5 of FIG. 1, showing the flip-top cap in the closed position on the container and showing that the radially outwardly extending short-arc inner cap-retainer latch of the flip-top cap is arranged to lie under and engage a downwardly facing surface of the inner retention lug appended to the cylindrical inner wall of the container to retain the flip-top cap in the closed position on the container and also showing that the radially inwardly extending long-arc outer cap-retainer latch of the flip-top cap is arranged to lie under and engage a downwardly facing surface of the ring-shaped outer retention lug appended to the cylindrical outer wall of the container to retain the flip-top cap in the closed position on the container.

As shown best in FIGS. 2, 3, and 5, container 12 includes a receptacle 24 having cylindrical inner and outer walls 25, 26 and a bottom wall 27 and a cap-shield collar 28 appended to receptacle 24. Lugs 21, 22 are also appended to an upper cylindrical end 23 of receptacle 24 and are arranged to lie in a space below a top edge 30 of receptacle 24 and above cap-shield collar 28 as shown best in FIG. 8. Upper cylindrical end 23 of receptacle 24 is configured to define mouth 36 as shown in FIG. 2.

Cap-shield collar 28 is appended to cylindrical outer wall 26 of receptacle 24 and arranged to extend about 320° around cylindrical outer wall 26 from one side 181 of hinge 18 to an opposite side 182 of hinge 18 as suggested in FIG. 2. Cap-shield collar 28 includes, in series, a wide arc-shaped first flange 31, a wide arc-shaped second flange 32, and a relatively narrow middle flange 33 located between first and second flanges 31, 32 and in diametrically opposed relation to hinge 18 as suggested in FIG. 3. Cap-shield collar 28 is configured to "shield" an underside of rim 34 (see FIG. 2) of flip-top cap 16 as suggested in FIGS. 5-8 when flip-top cap 16 is moved to assume a "closed" position on container 12.

Inner retention lug 21 is appended to a portion of cylindrical inner wall 25 of receptacle 24 as suggested in FIG. 2 in a location near a mouth 36 opening into an interior region 38 of receptacle 24. In an illustrative embodiment, inner retention lug 21 is a short segment having an arc length of about 20° and projecting in a radially inwardly extending direction into interior region 38 of receptacle 24. Inner retention lug 21 mates with cap retainer 20 included in flip-top cap 16 to retain flip-top cap 16 in a closed position.

Outer retention lug 22 is ring-shaped and appended to cylindrical outer wall 26 of receptacle 24. Outer retention lug 22 is located below a circular top edge 39 of receptacle 24 and above cap-shield collar 28 as suggested in FIGS. 2, 3, and 8. Outer retention lug 22 projects in a radially outwardly extending direction away from interior region 38 of receptacle 24. Outer retention lug 21 also mates with cap retainer 20 included in flip-top cap 16 to retain flip-top cap 16 in a closed position.

Figure 4:
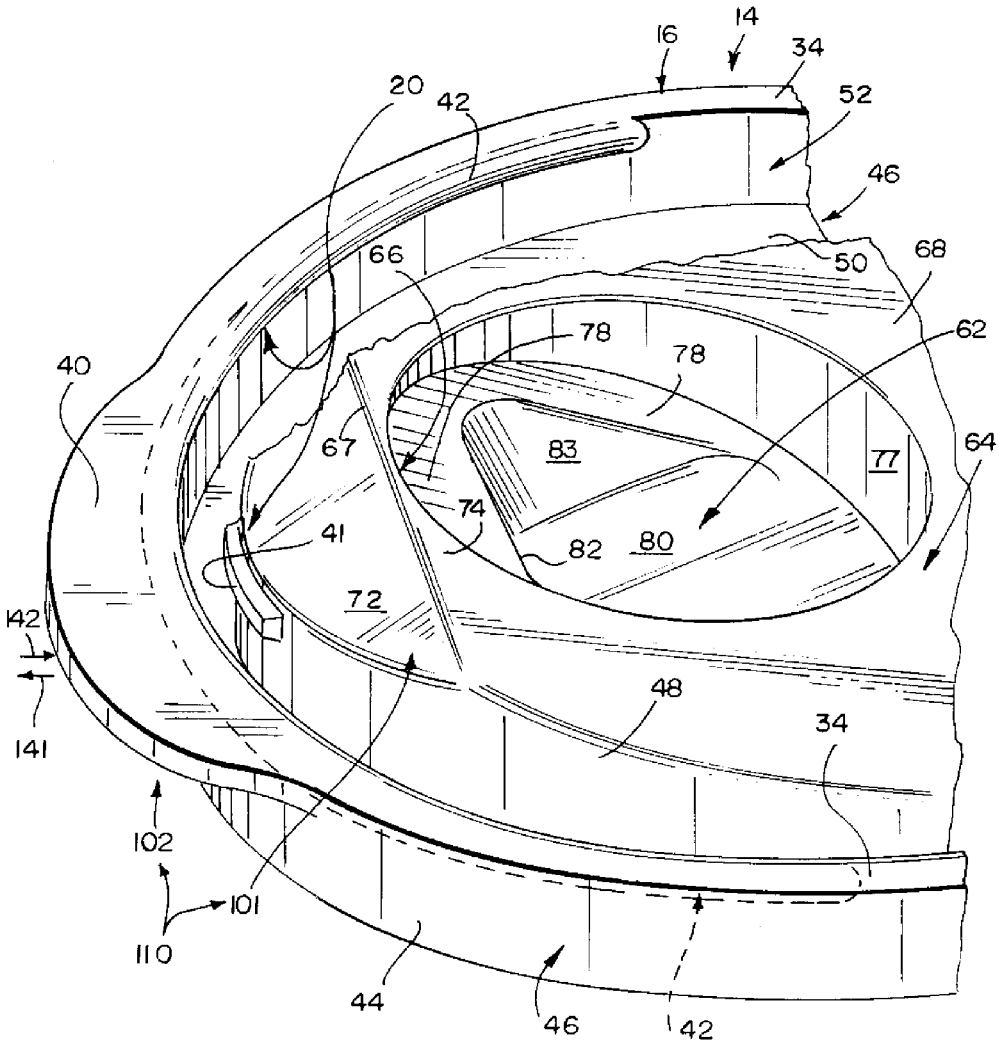
FIG. 4 is an enlarged partial perspective view of the flip-top cap shown in FIGS. 2 and 3 showing a short-arc inner cap-retention latch having a "short" arc length and extending in a radially outward direction toward a lift-tab included in the flip-top cap and showing a long-arc outer cap-retention latch having a relatively "long" arc length and extending in a radially inward direction from an outer annular side wall of the flip-top cap adjacent to the lift-tab.
Figure 8:
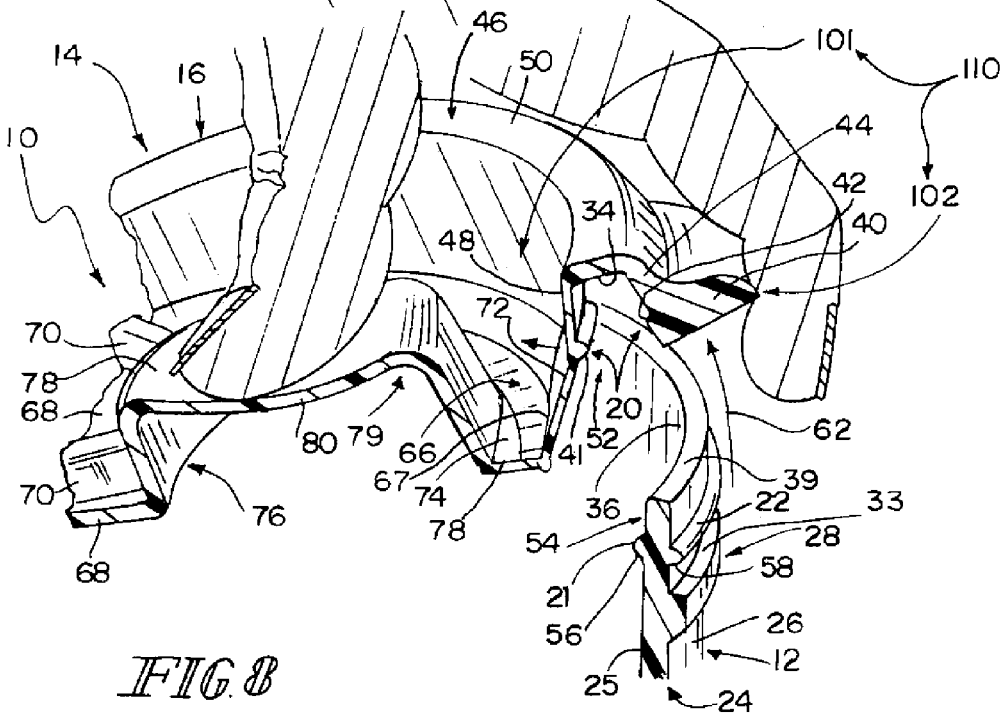

Cap retainer 20 includes an inner cap-retention latch 41 and an outer cap-retention latch 42 in "exposed" positions on the underside of flip-top cap 16 as shown best in FIGS. 4 and 8. When flip-top cap 16 is moved to assume a closed position on receptacle 24 of container 12 as suggested, for example, in FIGS. 1 and 5, inner cap-retention latch 41 mates with inner retention lug 21 and outer cap-retention latch 42 mates with outer retention lug 22 as shown, for example, in FIG. 5 to retain flip-top cap 16 in the closed position on receptacle 24.

In an illustrative embodiment, inner cap-retention latch 41 has a "short" arc length of about 15° and outer cap-retention latch 42 has a relatively longer "long" arc length of about 180°. Also in illustrative embodiments, inner cap-retention latch 41 is arranged to extend in a radially outward direction 141 toward a lift-tab 40 included in child-resistant closure 14 and coupled to flip-top cap 16 while outer cap retention latch 42 is arranged to extend in a radially inward direction 142 from an outer annular side wall 44 included in flip-top cap 16 and coupled to lift-tab 40.

In the illustrated embodiment, flip-top cap 16 includes a circular rim 46 (shown best in FIGS. 1, 4, and 8) including an outer annular side wall 44 coupled to lift-tab 40, inner annular side wall 48, and annular top wall 50. Circular rim 46 is formed to include an annular channel 52 sized to receive a cylindrical upper end 54 of receptacle 24 when flip-top cap 16 is moved to the closed position as shown, for example, in FIG. 5. Both of "short-arc" inner cap retention latch 41 and "long-arc" outer cap retention latch 42 are arranged to lie in annular channel 52 and to extend toward one another as suggested in FIGS. 4 and 8.

When flip-top cap 16 is moved to assume the closed position shown, for example, in FIG. 5, short-arc inner cap retention latch 41 mates with inner retention lug 21 and long-arc outer cap retention latch 42 mates with ring-shaped outer retention lug 22. In an illustrative embodiment, the radially outwardly extending short-arc inner cap retention latch 41 of flip-top cap 16 is arranged to lie under and engage a downwardly facing surface 56 of inner retention lug 21 appended to inner wall 25 of receptacle 24 as suggested, for example, in FIGS. 5 and 6, to retain flip-top cap 16 in the closed position on container 12. Also in illustrative embodiments, the radially inwardly extending long-arc outer cap-retainer latch 42 of flip-top cap 16 is arranged to lie under and engage a downwardly facing surface 58 of the ring-shaped outer retention lug 22 appended to cylindrical outer wall 26 of receptacle 24 as suggested, for example, in FIGS. 6 and 7, to retain flip-top cap 16 in the closed position on container 12.

An inner latch actuator 60 is included in flip-top cap 16 and coupled, for example, to inner annular side wall 48 of circular rim 46. Inner latch actuator 60 is configured to provide means for disengaging inner cap-retention latch 41 from inner retention lug 21 during a first stage of cap removal as suggested, for example, in FIG. 6. Lift-tab 40 is then raised in direction 62 as suggested in FIGS. 7 and 8 during a second stage of cap removal to release flip-top cap 16 so it can be moved to an opened position.

In an illustrative embodiment, inner latch actuator 60 includes a button 62 and a button mount 64 configured to support button 62 for movement relative to circular rim 46. Inner latch actuator 60 also includes a deformable latch mover 66 arranged to interconnect button 62 and a portion of inner annular side wall 48 near to inner retention latch 41 as shown, for example, in FIGS. 1, 2, 4, 5, and 8.

Button mount 64 includes an arcuate inclined plate 68 having an outer edge appended to inner annular side wall 48 of circular rim 46 and an inner edge appended to button 62. Button mount 64 also includes radially extending stiffening ribs 70 appended to inclined plate 68 as shown in FIGS. 1 and 5.

Latch mover 66 includes a frustoconical inclined wall 72 coupled to inner annular side wall 48 and a support wall 74 arranged to interconnect button 62 and frustoconical inclined wall 72. As suggested in FIG. 5, walls 72 and 74 are relatively thin (and have a thickness "t") as compared to plate 68 (which has a greater thickness "T") and deform when button 62 is pushed inwardly as shown in FIGS. 6 and 7 to cause movement of inner annular side wall 48 (and inner retention latch 41) away from outer annular side wall 44 to cause inner retention latch 41 to disengage inner retention lug 21.

As suggested in FIGS. 1, 4, and 5, button 62 includes a button base 76 having an arcuate side wall 77 appended to inclined plate 68 and stiffening ribs 70 and an inclined top wall 78. Inclined top wall 78 is also thin (like inclined wall 72 and support wall 74) as compared to plate 68 to yield and deform when button 62 is pushed so that inner retention latch 41 of flip-top cap 16 is moved to disengage inner retention lug 21 on receptacle 24.

Figure 6:
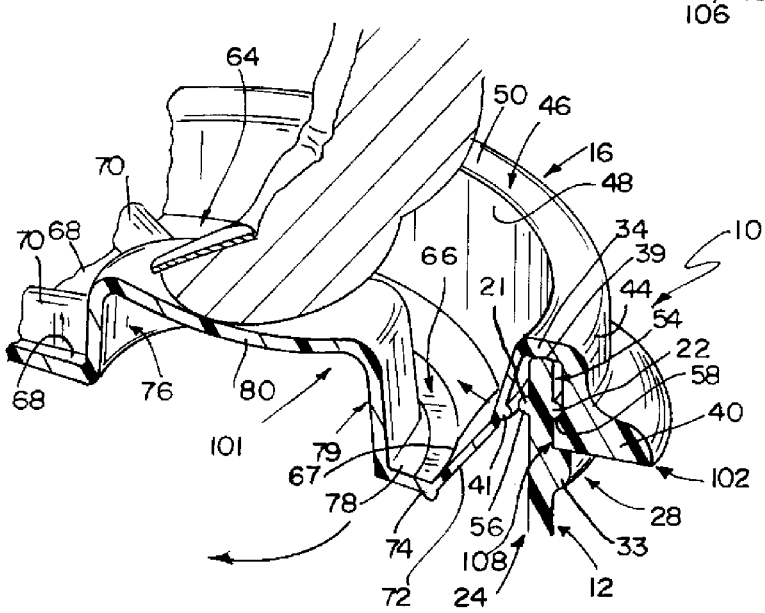
FIGS. 6-8 show, in series, three stages of opening the flip-top cap included in the vial of FIGS. 1-5.
Figure 7:
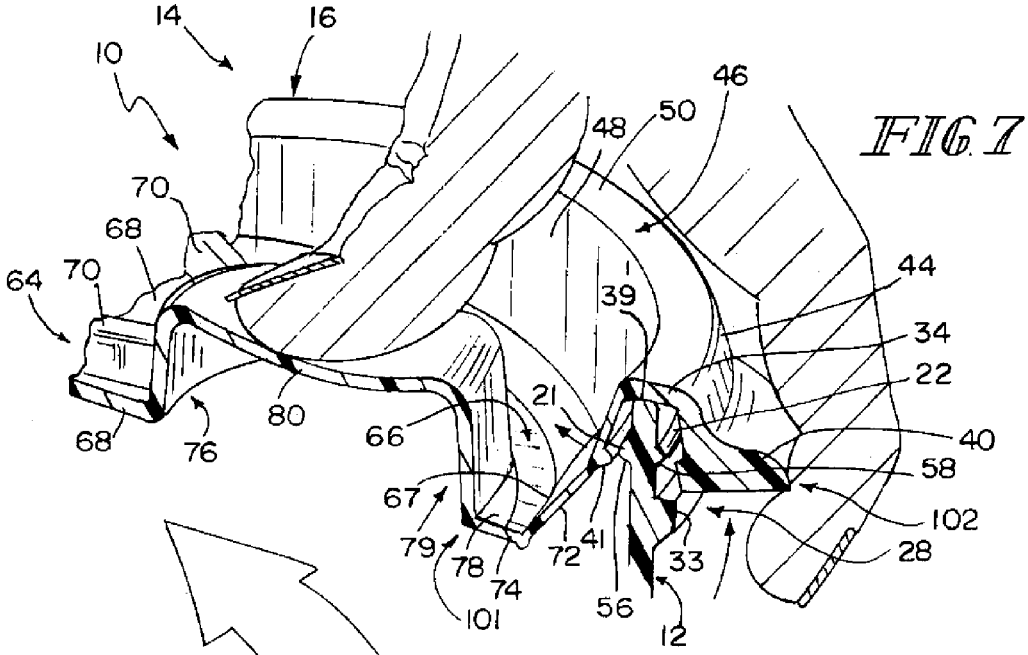

Button 62 also includes a button pad 79 adapted to be pressed by a user's thumb as suggested in FIGS. 6-8 and coupled to inclined top wall 78 of button base 76 as suggested in FIG. 1. In the illustrated embodiment, button pad 79 includes a top wall 80 and three side walls 81, 82, 83 appended to a perimeter edge of the top wall as suggested in FIGS. 1 and 3.

Various stages of opening flip-top cap 16 are illustrated in FIGS. 5-8 in accordance with an illustrative embodiment of the present disclosure. Flip-top cap 16 is opened by pushing downwardly on button pad 79 of button 62 as suggested in FIGS. 6-8 to deform latch mover 66 (e.g., inclined wall 72 and support wall 74 along fold line 67) included in inner latch actuator 60 to cause short-arc inner cap-retention latch 41 of flip-top cap 16 to disengage inner retention lug 21 of receptacle 24. It is also necessary to pull upwardly on lift-tab 40 as suggested in FIGS. 7 and 8 to disengage long-arc outer cap-retention latch 42 from ring-shaped outer retention lug 22.

Vial 10 includes a container 12 including a receptacle 24 formed to include an interior region 38 and a mouth 36 opening into interior region 38 as shown, for example, in FIG. 2. Container 12 also includes an inner retention lug 21 coupled to receptacle and located inside interior region 38 and an outer retention lug 22 coupled to receptacle 24 and located outside interior region 38 as suggested in FIGS. 2 and 5.

Vial 10 also includes a child-resistant closure 14 including a cap 16 configured to be mounted on receptacle 24 in a closed position to close mouth 36 as suggested in FIGS. 1 and 5 and separated from receptacle 24 to open mouth 36 as suggested in FIGS. 2, 3, and 8. Child-resistant closure 14 also includes a lift-tab 40 coupled to cap 16.

Child-resistant closure 14 further includes an inner cap-retention latch 41 mated to inner retention lug 21 upon movement of cap 16 to the closed position to resist separation of cap 16 from receptacle 24 and an outer cap-retention latch 42 mated to outer retention lug 22 upon movement of cap 16 to the closed position also to resist separation of cap 16 from receptacle 24 as suggested in FIG. 5. Child-resistant closure 14 also includes first-stage cap-release means 101 for disengaging inner cap-retention latch 41 from the inner retention lug 21 during a first stage of cap removal as suggested in FIGS. 5 and 6 to allow cap 16 to be decoupled from receptacle 24 upon upward movement of lift-tab 40 relative to receptacle 24 to disengage outer cap-retention latch 42 from outer retention lug 22 during a subsequent second stage of cap removal as suggested in FIGS. 6 and 7 to release cap 16 so that cap 16 can be moved relative to receptacle 24 to assume the opened position separated from receptacle 24.

Cap 16 includes a circular rim 46 configured to mate with receptacle 24 upon movement of cap 16 to assume the closed position as suggested in FIGS. 1 and 5. First-stage cap-release means 101 includes a button 62 surrounded by circular rim 46 and a button mount 64 coupled to button 62 and to circular rim 46 and configured to support button 62 for movement relative to circular rim 46. Cap 16 also includes a deformable latch mover 66 coupled to button 62 and to circular rim 46 and configured to deform in response to movement of button 62 relative to circular rim 46 to cause inner cap-retainer latch 41 to move toward button 62 to disengage inner retention lug 21 as suggested in FIG. 6.

Circular rim 46 includes an outer annular side wall 44 arranged to surround receptacle 24 upon movement of cap 16 to assume the closed position, an inner annular side wall 48 arranged to extend through mouth 36 into interior region 38 of receptacle 24 upon movement of cap 16 to assume the closed position, and an annular top wall 50 interconnecting outer and inner annular side walls 44, 48 as suggested in FIG. 5. Inner cup-retention latch 41 is coupled to inner annular side wall 48 of circular rim 46 as suggested in FIG. 4.

Deformable latch mover 66 includes a frustoconical inclined wall 72 coupled to inner annular side wall 48 and a support wall 74 arranged to interconnect button and frustoconical inclined wall 72 as suggested in FIG. 5. Frustoconical inclined wall 72 and support wall 74 are arranged to move relative to one another about, for example, fold line 67, in response to inward movement of button 62 toward interior region 38 of receptacle 24 to cause movement of inner annular side wall 48 away from outer annular side wall 44 to cause inner cap-retention latch 41 to disengage inner retention lug 21 as suggested in FIG. 6.

Lift-tab 40 is coupled to outer annular side wall 44. Lift-tab 40 is also arranged to lie outside of interior region 38 of receptacle 24 in spaced-apart relation to inner cap-retainer latch 41 to locate an upper portion of receptacle 24 therebetween upon movement of cap 16 to assume the closed position.

Receptacle 24 includes a cylindrical upper end 23 defining mouth 36 as shown in FIG. 2. Cylindrical upper end 23 includes an inner wall 26 carrying inner retention lug 21 and an outer wall 26 carrying outer retention lug 22 as suggested in FIGS. 2 and 3. Outer annular side wall 44 of circular rim 46 carries outer cap-retention latch 42 as suggested in FIG. 4. Inner and outer cap-retention latches 41, 42 cooperate with annular top wall 50 of the circular rim 46 to define a space therebetween receiving inner and outer retention lugs 21, 22 upon movement of cap 16 to assume the closed position as suggested in FIG. 5.

Button mount 64 includes an inclined plate 68 coupled to circular rim 46 and to button 62 and configured to have a first thickness "T" as suggested in FIG. 5. Deformable latch mover 66 includes a frustoconical inclined wall 72 coupled to circular rim 46 and a support wall 74 arranged to interconnect button 62 and frustoconical inclined wall 72. Each of frustoconical inclined wall 72 and support wall 74 are relatively thin and have a thickness "t" (see FIG. 5) less than the first thickness to cause deformable latch mover 66 to deform when button 62 is pushed inwardly toward interior region 38 of receptacle 24 to cause inner cap-retention latch 41 to disengage inner retention lug 21 as suggested in FIG. 6. Frustoconical inclined wall 72 mates with support wall 74 along fold line 67 as suggested in FIGS. 5-8.

Child-resistant closure 14 further includes a hinge 18 interconnecting receptacle 24 and cap 16 to establish cap 16 as a "flip-top" cap 16. Lift-tab 40 is located in spaced-apart relation to hinge 18 to cause inner cap-retention latch 41 and inner retention lug 21 to lie therebetween upon movement of cap 16 to assume the closed position. Inner retention lug 21 is located in a space provided between inner cap-retention latch 41 and lift-tab 40 upon movement of cap 16 to assume the closed position.

Vial 10 includes a cap retainer 104 that provides means for retaining cap 16 in a closed position on receptacle 24 as suggested in FIG. 5. In an illustrative embodiment, cap retainer 104 includes an inner cap lock 106 and an outer cap lock 108. Inner cap lock 106 includes inner cap-retention latch 41 and inner retention lug 21. Outer cap lock 108 includes outer cap-retention latch 42 and outer retention lug 22.

Vial 10 also includes a cap releaser 110 coupled to cap 16 to move therewith relative to receptacle 24. Cap releaser 110 includes first-stage cap-release means 101 for unmating inner cap-retention latch 41 from inner retention lug 21 during a first stage of cap removal as suggested in FIG. 6. Cap releaser 110 also includes second-stage cap-release means 102 for unmating outer cap-retention latch 42 from outer retention lug 22 during a subsequent second stage of cap removal as suggested in FIG. 7.

In an illustrative embodiment, three stages of opening flip-top cap 16 included in vial 10 are shown, in series, in FIGS. 6-8. As suggested in FIG. 6, movement of inner latch actuator 60 included in flip-top cap 16 in response to a downward force applied, for example, by a thumb of a user, causes movement inner cap-retention latch 41 relative to receptacle 24 to disengage the radially inwardly extending inner retention lug 21 included in container 12 during a first stage of opening flip-top cap 16. As suggested in FIG. 7, movement of outer latch actuator 40 included in child-resistant closure 14 in response to an upward force applied, for example, by an index finger of the user (while the user's thumb continues to push downwardly on a button 62 included in inner latch actuator 60), causes movement of outer cap-retainer latch 42 relative to receptacle 24 to disengage the radially outwardly extending outer retention lug 22 included in container 12 during a second stage of opening flip-top cap 16. As suggested in FIG. 8, movement of flip-top cap 16 (on hinge 18) away from the closed position toward the opened position takes place during a third stage of opening flip-top cap 16.

The invention claimed is:

1. A vial comprising a container including a receptacle formed to include an interior region and a mouth opening into the interior region, an inner retention lug coupled to the receptacle and located inside the interior region, and an outer retention lug coupled to the receptacle and located outside the interior region, and a child-resistant closure including a cap configured to be mounted on the receptacle in a closed position to close the mouth and separated from the receptacle to open the mouth and a lift-tab coupled to the cap, the child-resistant closure further including an inner cap-retention latch mated to the inner retention lug upon movement of the cap to the closed position to resist separation of the cap from the receptacle, an outer cap-retention latch mated to the outer retention lug upon movement of the cap to the closed position also to resist separation of the cap from the receptacle, and first-stage cap-release means for disengaging the inner cap-retention latch from the inner retention lug during a first stage of cap removal to allow the cap to be decoupled from the receptacle upon upward movement of the lift-tab relative to the receptacle to disengage the outer cap-retention latch from the outer retention lug during a subsequent second stage of cap removal to release the cap so that the cap can be moved relative to the receptacle to assume the opened position separated from the receptacle.

2. The vial of claim 1, wherein the cap includes a circular rim configured to mate with the receptacle upon movement of the cap to assume the closed position and the first-stage cap-release means includes a button surrounded by the circular rim, a button mount coupled to the button and to the circular rim and configured to support the button for movement relative to the circular rim, and a deformable latch mover coupled to the button and to the circular rim and configured to deform in response to movement of the button relative to the circular rim to cause the inner cap-retainer latch to move toward the button to disengage the inner retention lug.

3. The vial of claim 2, wherein the circular rim includes an outer annular side wall arranged to surround the receptacle upon movement of the cap to assume the closed position, an inner annular side wall arranged to extend through the mouth into the interior region of the receptacle upon movement of the cap to assume the closed position, and an annular top wall interconnecting the outer and inner annular side walls, and wherein the inner cap-retention latch is coupled to the inner annular side wall of the circular rim.

4. The vial of claim 3, wherein the deformable latch mover includes a frustoconical inclined wall coupled to the inner annular side wall and a support wall arranged to interconnect the button and the frustoconical inclined wall and wherein the frustoconical inclined wall and the support wall are arranged to move relative to one another in response to inward movement of the button toward the interior region of the receptacle to cause movement of the inner annular side wall away from the outer annular side wall to cause the inner cap-retention latch to disengage the inner retention lug.

5. The vial of claim 3, wherein the lift-tab is coupled to the outer annular side wall and arranged to lie outside of the interior region of the receptacle in spaced-apart relation to the inner cap-retainer latch to locate an upper portion of the receptacle therebetween upon movement of the cap to assume the closed position.

6. The vial of claim 3, wherein the receptacle includes a cylindrical upper end defining the mouth, the cylindrical upper end includes an inner wall carrying the inner retention lug and an outer wall carrying the outer retention lug, the outer annular side wall of the circular rim carries the outer cap-retention latch, and the inner and outer cap-retention latches cooperate with the annular top wall of the circular rim to define a space therebetween receiving the inner and outer retention lugs upon movement of the cap to assume the closed position.

7. The vial of claim 3, wherein the button includes a button base having an arcuate side wall coupled to the button mount and an inclined top wall and a button pad adapted to be pressed by a user's thumb and coupled to the inclined top wall of the button base, and the button pad includes a top wall and three side walls appended to a perimeter edge of the inclined top wall of the button base.

8. The vial of claim 2, wherein the button mount includes an inclined plate coupled to the circular rim and to the button and configured to have a first thickness and the deformable latch mover includes a frustoconical inclined wall coupled to the circular rim and a support wall arranged to interconnect the button and the frustoconical inclined wall and wherein each of the frustoconical inclined wall and the support wall are relatively thin and have a thickness less than the first thickness to cause the deformable latch mover to deform when the button is pushed inwardly toward the interior region of the receptacle to cause the inner cap-retention latch to disengage the inner retention lug.

9. The vial of claim 8, wherein the frustoconical inclined wall mates with the support wall along an arcuate fold line.

10. The vial of claim 8, wherein the receptacle includes a cylindrical upper end defining the mouth, the cylindrical upper end includes an inner wall carrying the inner retention lug and an outer wall carrying the outer retention lug, the outer annular side wall of the circular rim carries the outer cap-retention latch, and the inner and outer cap-retention latches cooperate with the annular top wall of the circular rim to define a space therebetween receiving the inner and outer retention lugs upon movement of the cap to assume the closed position.

11. The vial of claim 10, wherein the inner retention lug is a short segment having an arc length of about 20° and the outer retention lug is ring-shaped.

12. The vial of claim 10, wherein the cap further includes a cap-shield collar coupled to the receptacle and arranged to lie outside the interior region and in spaced-apart relation to a circular top edge of the receptacle and wherein the outer retention lug is located below the circular top edge and above the cap-shield collar.

13. The vial of claim 1, wherein the child-resistant closure further includes a hinge interconnecting the receptacle and the cap to establish the cap as a flip-top cap, the lift tab is located in spaced-apart relation to the hinge to cause the inner cap-retention latch and the inner retention lug to lie therebetween upon movement of the cap to assume the closed position, and the inner retention lug is located in a space provided between the inner cap-retention latch and the lift-tab upon movement of the cap to assume the closed position.

14. A vial comprising a receptacle formed to include an interior region, a cap configured to be mounted on the receptacle in a closed position to close a mouth opening into the interior region, a cap retainer including an inner cap lock and an outer cap lock, the inner cap lock including an inner retention lug coupled to the receptacle and an inner cap-retention latch coupled to the cap and arranged to mate with the inner cap-retention lug upon movement of the cap to the closed position, the outer cap lock including an outer retention lug coupled to the receptacle and an outer cap-retention latch coupled to the cap and arranged to mate with the outer cap-retention lug upon movement of the cap to the close position, and a cap releaser coupled to the cap to move therewith and configured to include first-stage cap-release means for unmating the inner cap-retention latch from the inner retention lug during a first stage of cap removal and second-stage cap-release means for unmating the outer cap-retention latch from the outer retention lug during a subsequent second stage of cap removal while the inner cap-retention latch and the inner retention lug remain unmated so that the cap can be moved relative to the receptacle to assume an opened position separated from the receptacle.

15. The vial of claim 14, wherein the cap includes a circular rim configured to mate with the receptacle upon movement of the cap to assume the closed position and the first-stage cap-release means includes a button surrounded by the circular rim, a button mount coupled to the button and to the circular rim and configured to support the button for movement relative to the circular rim, and a deformable latch mover coupled to the button and to the circular rim and configured to deform in response to movement of the button relative to the circular rim to cause the inner cap-retainer latch to move toward the button to disengage the inner retention lug.

16. The vial of claim 15, wherein the second-stage cap-release means includes a lift-tab coupled to the circular rim and arranged to lie outside of the interior region upon movement of the cap to assume the closed position.

* * * * *